United States Patent [19]

Himmetsberger et al.

[11] 4,185,852

[45] Jan. 29, 1980

[54] SAFETY SKI BINDING

[75] Inventors: Alois Himmetsberger, Vienna; Erwin Weigl, Brunn am Gebirge, both of Austria

[73] Assignee: TMC Corporation, Baar, Switzerland

[21] Appl. No.: 891,757

[22] Filed: Mar. 30, 1978

[30] Foreign Application Priority Data

Apr. 6, 1977 [AT] Austria ..... 2396/77

[51] Int. Cl.[2] ..... A63C 9/08

[52] U.S. Cl. ..... 280/618; 280/626

[58] Field of Search ..... 280/618, 626, 628, 629, 280/613, 617, 611, 634

[56] References Cited

U.S. PATENT DOCUMENTS

| | | | |
|---|---|---|---|
| 3,964,758 | 6/1976 | Kent | 280/618 X |
| 3,998,473 | 12/1976 | Schmidt | 280/618 |
| 4,082,313 | 4/1978 | Bryl | 280/618 |

FOREIGN PATENT DOCUMENTS

| | | | |
|---|---|---|---|
| 2246668 | 4/1974 | Fed. Rep. of Germany | 280/617 |
| 2305208 | 11/1976 | France | 280/618 |

*Primary Examiner*—Robert B. Reeves

*Assistant Examiner*—Gene A. Church

*Attorney, Agent, or Firm*—Blanchard, Flynn, Thiel, Boutell & Tanis

[57] ABSTRACT

A safety ski binding arrangement utilizing a sole plate pivotally secured to the ski and remaining with the ski following a release of the ski boot from engagement therewith. A front jaw is mounted on the sole plate and is adapted to move forwardly and rearwardly relative thereto. A locking mechanism is provided to hold the front jaw in a fixed position relative to the sole plate. Lateral forces applied to the locking arrangement will cause the sole plate to swivel about the pivot axis support therefor and effect an unlocking of the securement of the front jaw to the sole plate. The pressure applied by the ski boot to the front jaw will cause the front jaw to move forwardly away from the ski boot and facilitate a release of the ski boot from engagement with the ski. Following a release of the ski boot from engagement with the ski, a weak return spring generates the necessary force to effect a return of the sole plate to the longitudinally aligned position relative to the ski. In addition, the front jaw can be moved rearwardly until it becomes locked in a fixed relationship relative to the sole plate.

13 Claims, 12 Drawing Figures

Fig. 8
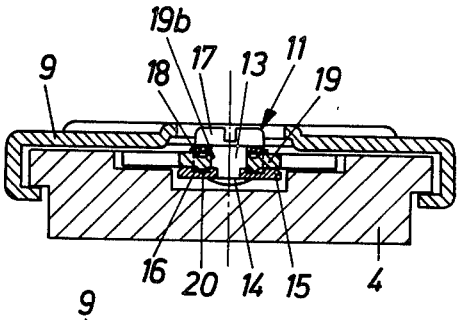
Fig. 9
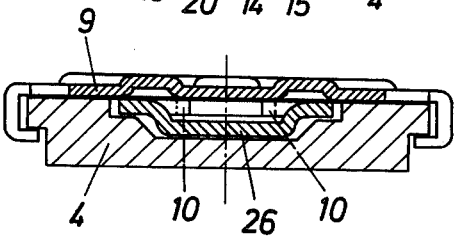
Fig.10a
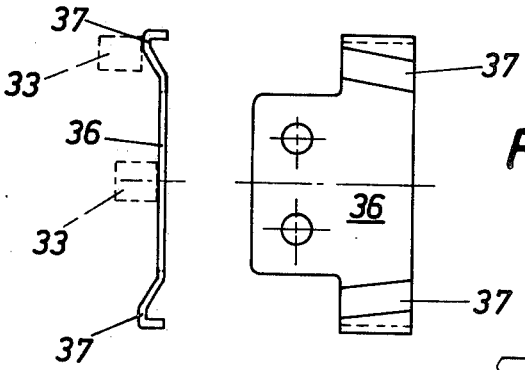
Fig.10b
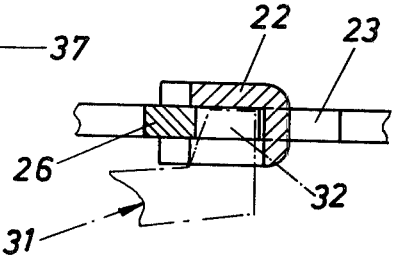
Fig.7a
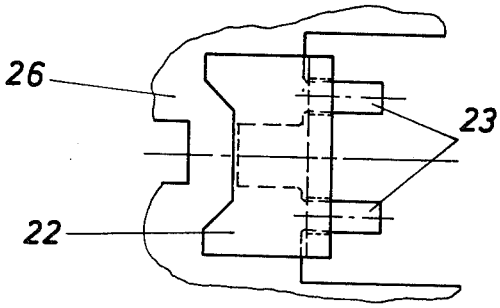
Fig.7b

SAFETY SKI BINDING

FIELD OF THE INVENTION

The invention relates to a safety ski binding comprising a swivel plate which has a holding jaw provided in the front part, and can be pivoted about an axis which is perpendicular with respect to the upper side of the ski and is held at the front end in the center position by means of a locking mechanism which releases upon exceeding a preferably adjustable torque and in which the holding jaw is arranged on a movable jaw plate.

BACKGROUND OF THE INVENTION

A safety ski binding of the above-mentioned type is substantially described in Austrian Pat. No. 245 448. In this known construction, the holding jaw is constructed as a side jaw which is common in ski bindings which have safety tensioning means. The swivel axis is arranged in the heel area. The jaw plate is thereby supported on the front part of the swivel plate and is constructed with respect to said swivel plate rotatably about an axis which is cut by the longitudinal center line of said swivel plate and which is perpendicular with respect to the upper surface of the ski. The jaw plate is locked against rotation in the center position of the swivel plate, which locking is cancelled during a swinging out of the swivel plate. Since the release of the ski boot through two swingable axes and, in addition, a longitudinal shift of one of the locked parts is needed, it is slightly complicated. The disadvantage of this construction consists further in that the ski boot is difficult to remove from the entire ski binding after a fall, even when according to the described construction an increased release is assured.

German OS No. 25 10 385 furthermore describes a front jaw, which after a predetermined swivelling path of the ski boot, is released from a locking engagement and is moved away from the tip of the ski boot through the action of a spring. As a result, an increased assurance for release of the ski boot from the ski binding parts is achieved, however, the additional requirements needed for this are hardly in tune with the degree of success. Moreover, the control elements which necessarily are of large dimensions in some of the embodiments described in this reference are not only connected with an increased danger of wear, they are also susceptible to breakdown. The return can only be done manually.

The purpose of the invention is now to provide in a front jaw of the above-mentioned type a specially operatively safe device which even under difficult ground and environmental conditions functions perfectly and after the release occurs causes an automatic return.

The set goal is achieved inventively by providing a locking part which engages the jaw plate through connecting pieces and which is loaded by a spring, which locking part is in the closed position (downhill position) of the binding locked by an arm of a rocking lever which can be pivoted through a limited range against the force of a spring about an axis which is positioned substantially parallel to the upper side of the ski and extends transversely to the longitudinal axis of the ski, the other arm of which rocking lever is in this position of the binding held in position pressed against a ski-fixed control member by a spring force and is released from the latter through swivelling upon the occurrence of an overload, and by returning the jaw into the initial position (and thus the sole plate) after the release of the ski boot has taken place caused by a return spring.

Due to the fact that a rocking lever and a locking part functioning as a locking mechanism which can become engaged and disengaged from same are provided and both the rocking lever and also the locking part are spring-loaded, the set goal is achieved satisfactorily. The outer forces which act onto the rocking lever cannot cause an unintended release operation, because the rocking lever is supported through the ski-fixed control member and reacts only to lateral stresses (to lateral swivelling forces). Since the sole plate in turn brings about through the locking mechanism which exists in the heel area a lateral swivelling of the sole plate both during the occurrence of purely lateral forces and also during so-called diagonal forces, it is assured that upon occurrence of a force which is dangerous for the foot of the skier a release operation is initiated. Whether such a release operation is indeed carried out, depends on the duration of the overload. Temporarily occurring impacts can be absorbed by the binding without introducing the final release operation; the binding has a sufficient amount of elasticity.

BRIEF DESCRIPTION OF THE DRAWINGS

Further advantages and details of the invention will be described more in detail with reference to the drawings, which illustrate one exemplary embodiment.

In the drawings:

FIGS. 1 and 2 are associated views of an inventive front jaw in connection with a sole plate, wherein FIG. 1 is a longitudinal cross-sectional view taken along the line I—I of FIG. 2 and FIG. 2 is a top view of FIG. 1, partially in cross section and in the closed position (downhill position) of the binding;

Figure 1:
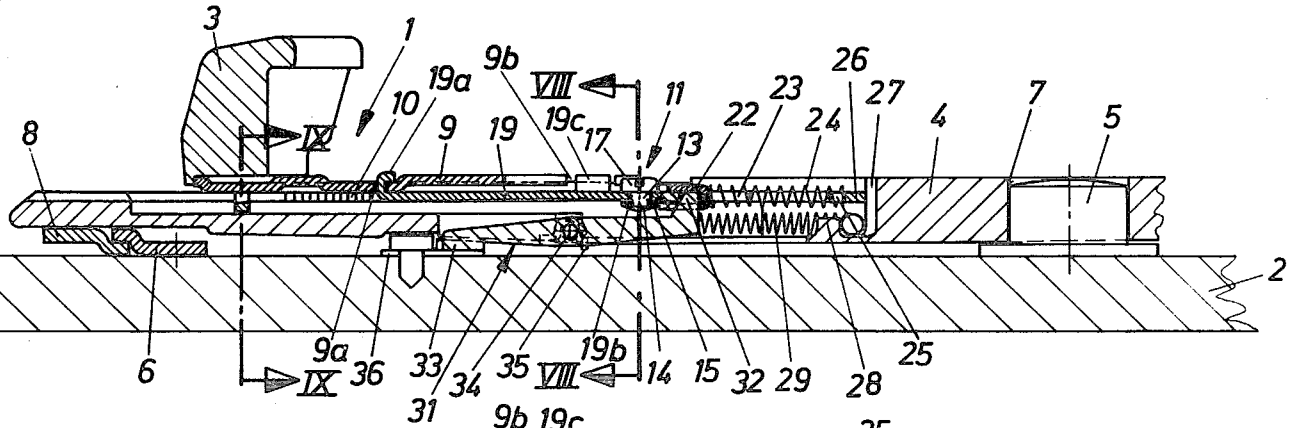
Figure 5:
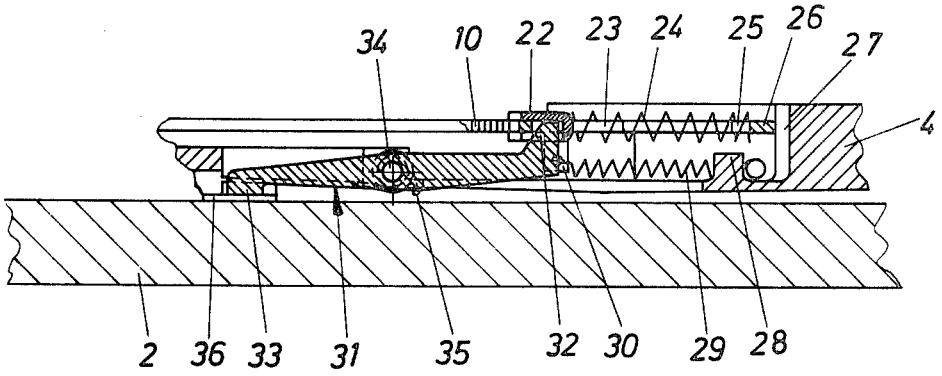
FIGS. 5 and 6 illustrate a detail of FIGS. 1 and 2 in an enlarged scale and in similar views.
Figure 6:
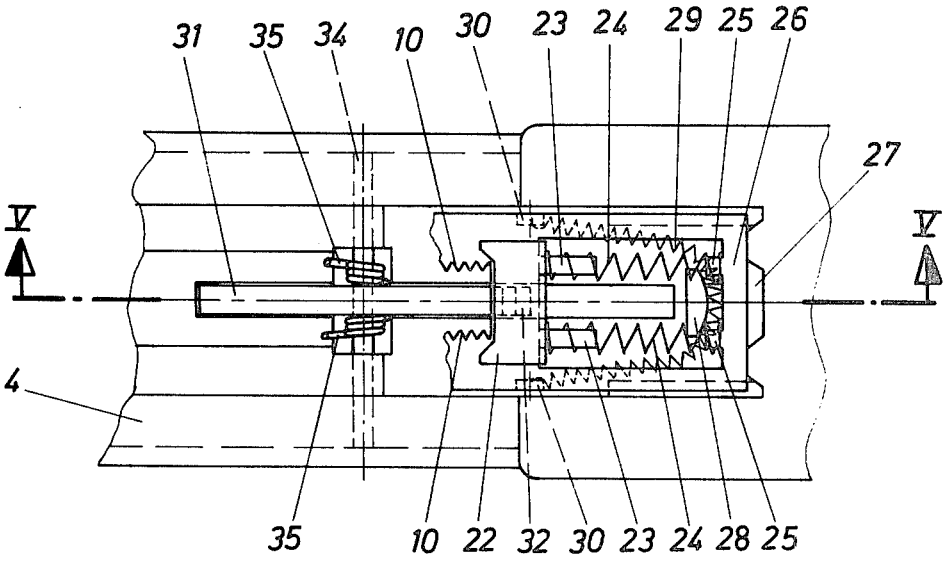

FIGS. *7a* and *7b* are enlarged views of a fragment of the support illustrated in FIGS. 5 and 6, respectively;

FIGS. 8 and 9 are cross-sectional views taken along the lines VIII—VIII or IX—IX of FIG. 1; and FIGS. 10*a* and 10*b* illustrate a detail of the control member.

DETAILED DESCRIPTION

Figure 2:
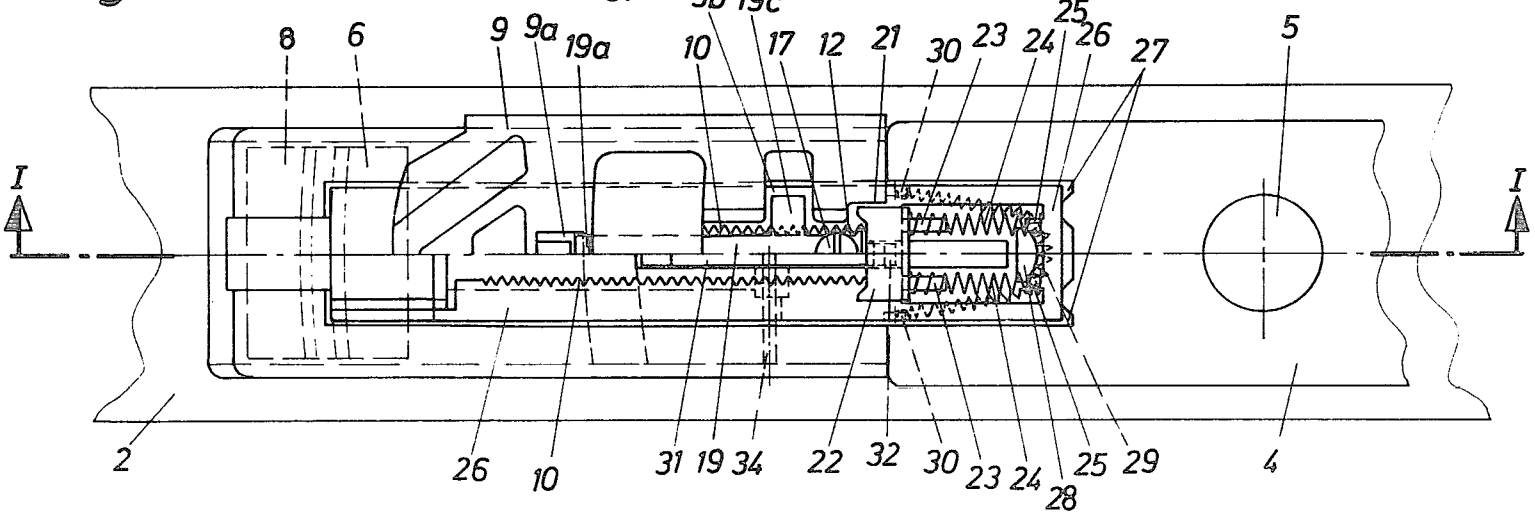

The front jaw, which as a whole is identified by reference numeral 1, is held on a sole plate 4 which is mounted on holding elements secured to the ski. A pin 5 and a holding part 6 are both secured to the ski. The sole plate 4 has a recess 7 therein, through which it is rotatably supported on the pin 5 and limited against removal therefrom. The holding part 6 has a bent section thereon engaged by a counterpiece 8 secured to the sole plate and also has a bent section thereon. Due to the fact that the spacing between the pin 5 and the holding part 6 is substantially constant (the spacing changes only in relation to the bend or flex in the ski), the sole plate 4 is prevented from lifting off from the ski 2 in a vertical direction. The bent sections of the holding part 6 and of the counterpiece 8 assure on the other hand an unhindered swivelling of the sole plate 4 about the axis of the pin 5. FIGS. 1 and 2 illustrate the sole plate without a ski boot (with initially untensioned thrust springs). The sole holder 3 is secured on a jaw plate 9. The jaw plate 9 grips, as can be better recognized in FIGS. 8 and 9, with lateral bent sections around the laterally projecting shoulders of the sole plate 4. A rack plate 26 is provided in the center area of the sole plate. The rack plate 26 has a plurality of opposed teeth 10 thereon which extend in the longitudinal direction of the ski and are arranged symmetrically in relationship to and on opposite sides of the longitudinal axis of the rack plate. A toothed detent 12 of an intermediate piece 19 is positioned between the opposed teeth and supports a locking device 11 which will be described more in detail hereinbelow. The detent 12 can become engaged and disengaged from said teeth 10 to facilitate an adjustment of the spacing between the jaw plate 9 and thus the sole holder 3 and the pin 5 and thus also the spacing between the (not illustrated) heel holder of the sole plate 4 and the jaw plate 9. In this manner, a longitudinal adjustment to the different ski boot sizes is assured. The jaw plate 9 has rigidifying portions thereon which are not identified in detail and which reinforce said jaw plate.

The locking device 11 is constructed as follows with reference to FIGS. 1, 2 and 8. The locking device 11 consists substantially of a clamping bolt 13, which has riveted thereto at its downwardly extending end a clamping plate 15 having two wing portions. Recesses 16 are constructed in the upper side of the clamping plate 15. A slotted head 17 is provided at the upwardly extending end of the clamping bolt 13, which head 17 is resiliently urged upwardly by a spring plate 18. The intermediate piece 19 has an opening 19*b* therein receiving the bolt 13 therein and is positioned between the clamping plate 15 and the spring plate 18. As a result, the spring plate 18 urges the head 17 of the bolt 13 upwardly and the intermediate piece 19 downwardly. The intermediate piece 19 has on the surface facing the clamping plate 15 detents 20, which are received in the recesses 16 of the clamping plate 15. In the engaged position, in which the toothed detent 12 of the intermediate piece engages the teeth 10, the detents 20 thereon rest in the recesses 16. If an adjustment is desired, a suitable tool, for example a coin, is inserted into the slot of the head 17 and is rotated at 90°, which causes the wings of the clamping plate 15 to be moved into a position which extends parallel to the longitudinal extent of the intermediate piece 19 and the engagement between the toothed detent 12 and the teeth 10 is cancelled. The locking device 11 can now be lifted out, can be moved together with the jaw plate 9 into the position corresponding with the ski boot which is to be newly inserted and can be relocked in the same manner by further rotating the slotted head 17 through 90°. During locking, the clamping plate 15 grips with its two wings under the rack plate 26 so that the teeth 10, 12 engage one another again but this time in a new location.

Figure 3:
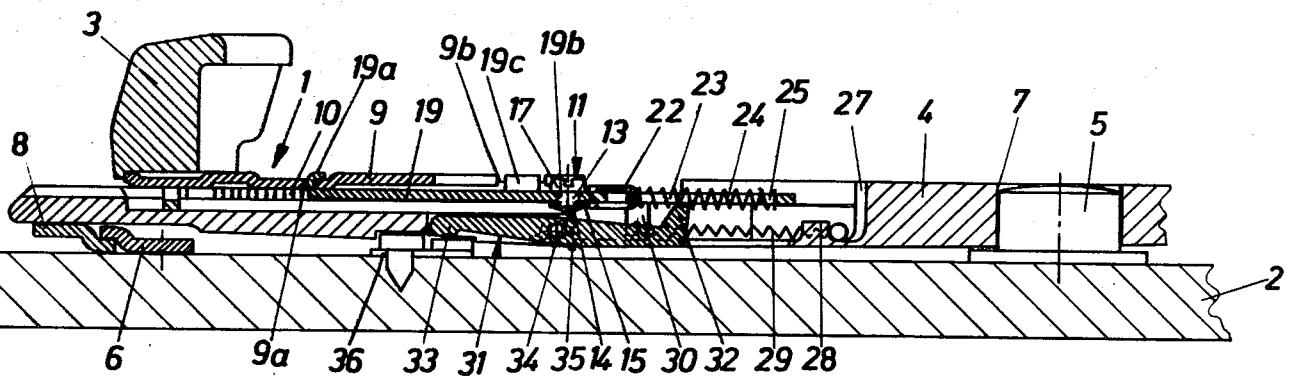
FIGS. 3 and 4 are views similar to FIGS. 1 and 2, respectively, and illustrate the front jaw in the swivelled (released) position.

The intermediate piece 19 engages, as can particularly be seen from FIGS. 1 and 3, with a duplicate bent section 19*a* and with projections 19*c* which are received in recesses 9*a* or 9*b* of the jaw plate 9, said jaw plate being swung along during a swivelling of the sole plate 4 together with the jaw plate 9. Since the locking device 11 is anchored with the intermediate piece 19, a longitudinal adjustment of the locking device 11 along the teeth 10 effects also the longitudinal adjustment of the jaw plate 9 relative to the sole holder 3, as already mentioned above. The jaw plate 9 has at its end adjacent the pin 5 a recess or notch 21, into which projects a support plate 22 which serves as a locking part. The support plate 22 is constructed substantially as a U-profile, which with the upper leg thereof lies approximately in the plane of the jaw plate 9 and the web or bight portion thereof, which extends substantially vertically downwardly, has holes therein receiving extensions 23 of the rack plate 26. Springs 24 are engaged with and extend between the support plate 22 and encircle the extensions at one end and holding lugs 25 on the rack plate 26 at the other end. The rack plate 26 is arranged in a recess 27 (see in particular FIG. 4) of the sole plate 4. The lower leg of the support plate 22 extends beneath the underside of the rack plate 26. A projection 28 which extends upwardly from the sole plate 4 can be recognized in the recess 27 in FIGS. 1 and 2. A spring 29 extends around the projection 28 and the two free ends thereof are secured on holders 30 arranged on the end of the rack plate 26 and on opposite lateral sides thereof, which end is remote from the projection 28.

The downwardly extending bent section of the support plate 22 is held in position (compare FIG. 1) against the force of the springs 24—which are the thrust springs of the ski binding—by an arm 32 of a rocking lever 31 which is pivotal through a limited range against the force of a torsion spring 35 about the axis of an axle 34 which extends substantially parallel to the upper side of the ski and transversely to the longitudinal axis of the ski. The rocking lever 31 is constructed substantially Z-shaped in cross section and the arrangement extends substantially horizontally. The lower leg of the support plate has an opening therein receiving one arm 32 of the rocking lever 31 therein. The other arm 33 of the rocking lever 31 is supported on a control member 36 fixed to the ski. The construction of the control member 36 can be recognized better with reference to FIGS. 10*a* and 10*b*. It can also be recognized with reference to these figures, that the arm 33 remains stationary relative to the control member 36, that is, does not pivot about the axle 34, as long as the arm 33 does not reach the peak of one of the webs 37 caused by a lateral swinging of the sole plate 4. Upon reaching or rather exceeding of this point, the support between the rocking lever 31 and the control member 36 shown in FIGS. 1 and 5 is cancelled, which causes also the locking arrangment between the one arm 32 and the support plate 22 to be cancelled. Since the sole holder 3 and thus also the jaw plate 9 is continuously loaded by the ski boot, it is easily understandable when through a cancellation of the locking connection between the arm 32 of the rocking lever 31 and the support plate 22, the sole holder 3 with the jaw plate 9 is moved forwardly in longitudinal direction of the ski, as this can be seen in FIGS. 3 and 4, since the webs 37 are constructed extending laterally toward the two ski edges and laterally rising. Since this shifting is due to the design, the length change achieved through this movement can be dimensioned such that the ski boot is released under all circumstances by the heel holder (not illustrated) and the skier can exit from the binding without any danger of injury. It is repeatedly pointed out that such a swivelling of the sole plate is caused only by outside forces, which would mean a risk of excess stress being applied to the foot of the skier.

Figure 4:
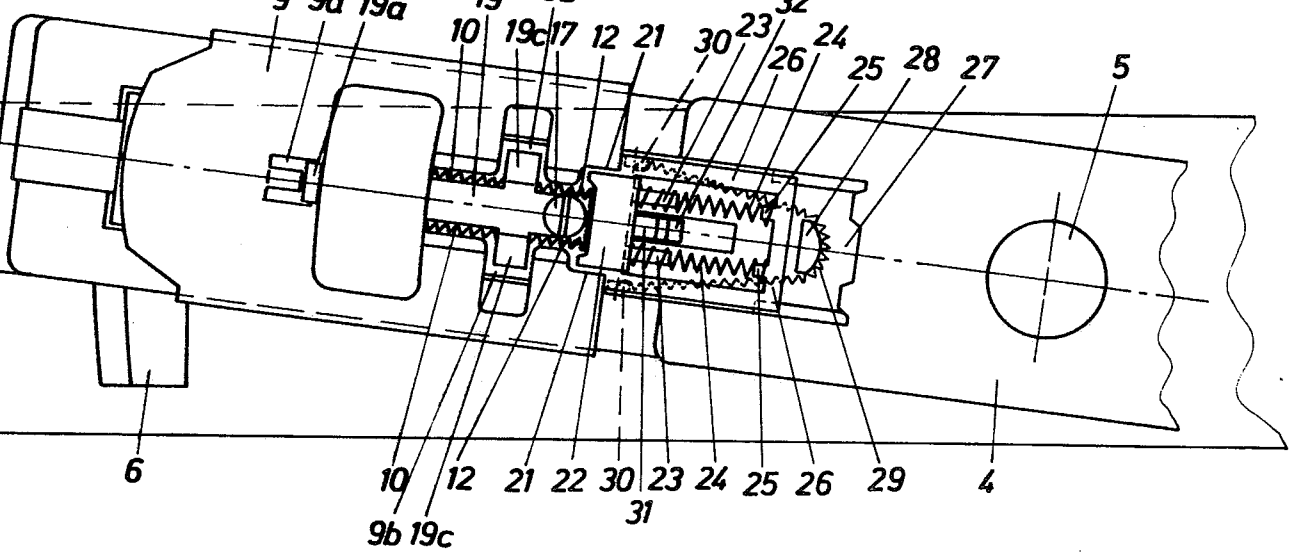

The position which is illustrated in FIGS. 3 and 4 is maintained only until the boot is removed. At the instant, at which the sole holder 3 or the jaw plate 9 is no longer loaded by outside forces, the action of the weak return spring 29 takes over and causes the guideway 26 and thus the jaw plate 9, connected to said guideway, to be returned with the sole holder 3 into the initial position. As soon as the support plate 22 is behind the arm 32 of the rocking lever 31, the rocking lever 31 is swung by the spring 35 into the initial position according to FIGS. 1 and 2 and the sole plate 4 is again ready to receive a boot. As one can observe in FIG. 6, in the present case the spring 35 is constructed as a torsion spring which is arranged symmetrically in relationship to the longitudinal axis of the sole plate 4. Furthermore, FIGS. 5 and 6 permit a better recognition of the already mentioned parts of the locking mechanism in an enlarged scale. In place of the torsion spring, the rocking lever can have on one or on both of the arms one or several pressure and/or tension springs. The support plate 22 can also be constructed L-shaped.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A safety ski binding for use on a ski, comprising:
an elongated sole plate;
pivot means mounted on said ski for pivotally supporting said sole plate about an axis which is perpendicular to an upper surface of a ski;
ski boot holding jaw means;
support means supporting said ski boot holding jaw means for movement along the longitudinal axis of said sole plate between a first position and a second position;
releasable locking means for releasably locking said ski boot holding jaw means to said sole plate in said first position thereof to facilitate a holding of a ski boot in a downhill skiing position in said ski binding, said releasable locking means comprising a locking part on at least one of said holding jaw means and said sole plate, and a two arm rocking lever pivotally mounted at a location intermediate said two arms on the other of said holding jaw means and said sole plate, one of said two arms engaging said locking part to hold said holding jaw means in said first position on said sole plate, a control member fixed to said upper surface of said ski, the other of said two arms engaging said control member, control surfaces on said control member adapted to become operatively engaged by said other of said two arms in response to a pivoting of said sole plate beyond a predetermined limit to effect a pivoting of said one arm away from said locking part to thereby unlock said holding jaw means from said sole plate and permit said ski boot to urge said holding jaw means toward said second position.

2. The safety ski binding according to claim 1, wherein said releasable locking means further includes first resilient means for continually urging said holding jaw means toward said first position and second resilient means continually urging said other arm of said rocking lever into engagement with said control member.

3. The safety ski binding according to claim 1, wherein said holding jaw means comprises a toe jaw and a jaw plate, said toe jaw being mounted on said jaw plate, and adjusting means for facilitating an adjustment of the position of said toe jaw relative to said pivot means to permit and ski binding to accommodate ski boots having differing lengths.

4. The safety ski binding according to claim 3, wherein said adjusting means includes a rack plate having teeth thereon which are arranged in longitudinal direction of said sole plate and an intermediate piece having a toothed detent thereon, said teeth engaging one another, and a releasable locking device for holding said teeth in engagement with one another, and said sole plate having a recess therein in which is housed said adjusting means.

5. The safety ski binding according to claim 4, wherein said locking part is constructed as a support plate having the form of an L- or U-profile, a first leg of said profile extending in longitudinal direction of said ski and a second leg thereof extending perpendicular to said upper surface of said ski.

6. The safety ski binding according to claim 5, wherein said support plate is constructed as a U-profile and wherein a third leg of said profile extends beneath said rack plate to secure said support plate against tilting.

7. The safety ski binding according to claim 4, wherein said rack plate has at an end remote from said toe jaw at least one extension extending in longitudinal direction of said ski away from said releasable locking means, said support plate being slidably disposed on said extension, and wherein said rack plate has at a finite spacing from said extension further remote from said toe jaw one holding bolt, and a spring engaging and extending between said support plate and said holding bolt.

8. The safety ski binding according to claim 4, wherein said rack plate is received in a pocket in the sole plate, and wherein the teeth on said rack plate are symmetrically arranged on opposite sides of the central longitudinal axis of said ski and facing inwardly of a recess in said rack plate, in which recess said intermediate piece is movably and selectably fixably arranged at least in one longitudinal dimension which corresponds to the intended adjusted position thereof.

9. The safety ski binding according to claim 4, wherein said releasable locking device includes a bolt for securing said intermediate piece to said rack plate, wherein said intermediate piece has at its end adjacent said toe jaw an upwardly projecting bent section extending into a recess in said jaw plate to form a securement of said intermediate piece with said jaw plate, wherein in the end of said intermediate piece remote from said bent section, there is provided an opening for receiving said bolt therein, wherein between said bent section and said opening, projections which are symmetrical about the longitudinal axis of said sole plate are provided which extend upwardly and are bent laterally outwardly on both sides of said intermediate piece, and which are received in recesses in said jaw plate and support said intermediate piece on said rack plate.

10. The safety ski binding according to claim 9, wherein jaw plate is shouldered in longitudinal direction of the ski in its area which is in engagement with said intermediate piece.

11. The safety ski binding according to claim 2, wherein said first resilient means is an elongated spring and wherein the midpart of said spring is suspended on an upwardly extending shoulder on said sole plate and the two free ends of said spring are secured to both sides of said rack plate.

12. The safety ski binding according to claim 1, wherein said control surfaces are symmetrically arranged on opposite sides of the longitudinal axis of said ski and each form an acute angle, said control surfaces extending laterally outwardly and upwardly toward the edges of said ski and the height of said control surface determines the point of disengagement of the associated arm of said rocking lever from said locking part.

13. The safety ski binding according to claim 4, wherein said second resilient means is a torsion spring which is wound around the pivot axis of said rocking lever and is arranged symmetrically with respect to the longitudinal axis of said sole plate.

* * * * *